US006190186B1

(12) United States Patent
Liao

(10) Patent No.: US 6,190,186 B1
(45) Date of Patent: Feb. 20, 2001

(54) SIGNAL ADAPTATION PLUG

(76) Inventor: Sheng-Hsin Liao, No. 137, San Chun St., Shu Lin Jen, Taipei Hsien (TW)

( * ) Notice: Under 35 U.S.C. 154(b), the term of this patent shall be extended for 0 days.

(21) Appl. No.: 09/371,853

(22) Filed: Aug. 11, 1999

(51) Int. Cl.[7] ..... H01R 13/44
(52) U.S. Cl. ..... 439/144; 439/676
(58) Field of Search ..... 439/144, 409, 439/676, 638

(56) References Cited

U.S. PATENT DOCUMENTS 5,679,013 * 10/1997 Matsungaga et al. ..... 439/144
5,762,518 * 7/1998 Tanigawa et al. ..... 439/409

* cited by examiner

*Primary Examiner*—Khiem Nguyen
*Assistant Examiner*—Hae Moon Hyeon

(74) *Attorney, Agent, or Firm*—Rosenberg, Klein & Lee

(57) ABSTRACT

A signal adaptation plug has a stage with a plug formed on one side and has at least an accommodation groove. A rotatable cover plate hinges on the stage and is situated on one side of the accommodation groove. A terminal assembly is composed of several pin terminals and is installed inside the stage. The pin terminal forms a first contact part and a second contact part at the accommodation groove and the plug of the stage. The first contact part of the pin terminal emerges from the gap groove of the contact surface of the stage. When the plug and the socket are not compatible, the cover plate is erected slantingly on the stage. The plug is plugged slantingly between the accommodation groove and the cover plate. The plug of the signal adaptation plug is then plugged on the socket. The signal adaptation plug of the present invention is integrally formed and has a small volume, the manufacture and assembly is thus simple and convenient. The production cost is also reduced. Moreover, the signal adaptation plug of the present invention is dust-proof and can avoid bad contact.

9 Claims, 8 Drawing Sheets

SIGNAL ADAPTATION PLUG

FIELD OF THE INVENTION

The present invention relates to a signal adaptation plug, more particularly, to a signal adaptation plug with a stage which has a connector installed on one side and has at least one socket region.

BACKGROUND OF THE INVENTION

The specification of the plug and socket of each country may be different. A signal adaptation plug is thus needed. As shown in FIG. 10, the conventional signal adaptation plug 20 comprises four stages with respective accessories connected to each other. A stage is used as a socket 7*a,* which has several pin terminals installed inside to connect the plug. Another stage is used as a connector 8*a* to plug into the socket of electronic equipment. The connector 8*a* has several pin terminals installed inside. The pin terminals of the socket 7*a* are connected to the pin terminals of the connector 8*a* through the lines 9*a*.

The conventional signal adaptation plug 20 has at least two stages and two pin terminals, the production cost is thus increased. The two stages are connected through the lines, resulting in easy open-circuit or bad contact. Moreover, the signal adaptation plug 20 can only provide one signal line for the connection of the plug, resulting in inconvenient usage.

The object of the present invention is to provide a signal adaptation plug with a stage. The stage has a connector installed on one side and has at least one socket region. The signal adaptation plug of the present invention is integrally formed and has a small volume, the manufacture and assembly is thus simple and convenient. The production cost is also reduced. Moreover, the signal adaptation plug of the present invention is dust-proof and can avoid bad contact.

One characteristic of the signal adaptation plug of the present invention is that it has a stage, which forms a connector on one side. The connector may be of American, English, or other specification. The stage has at least an accommodation groove. A rotatable cover plate hinges on the stage and is situated on one side of the accommodation groove. A terminal assembly is composed of several pin terminals and is installed inside the stage. The pin terminal forms contact parts at the accommodation groove and the connector of the stage. The contact part of the pin terminal emerges from the stage. When the plug and the socket are not compatible, the cover plate is erected slantingly on the stage. The plug is plugged slantingly between the accommodation groove and the cover plate. The pin terminal of the plug contacts with the contact part of the pin terminal inside the stage. The connector of the signal adaptation plug is then plugged on the socket.

Another characteristic of the signal adaptation plug of the present invention is that the stage has multiple accommodation grooves to plug several plugs. Usage convenience is thus increased. This gives the signal adaptation plug endless extension function.

Still another characteristic of the signal adaptation plug of the present invention is that the cover plate can be fixed to let the cover plate be fixed erectly slantingly on the stage.

Yet another characteristic of the signal adaptation plug of the present invention is that the pin terminal of the terminal assembly can be of different form to match the plugged plug. The signal adaptation plug of the present invention can connect various forms of plugs to increase the extent of the applications.

The various objects and advantages of the present invention will be more readily understood from the following detailed description when read in conjunction with the appended drawing, in which:

DETAILED DESCRIPTION OF PREFERRED EMBODIMENT

Figure 1A:
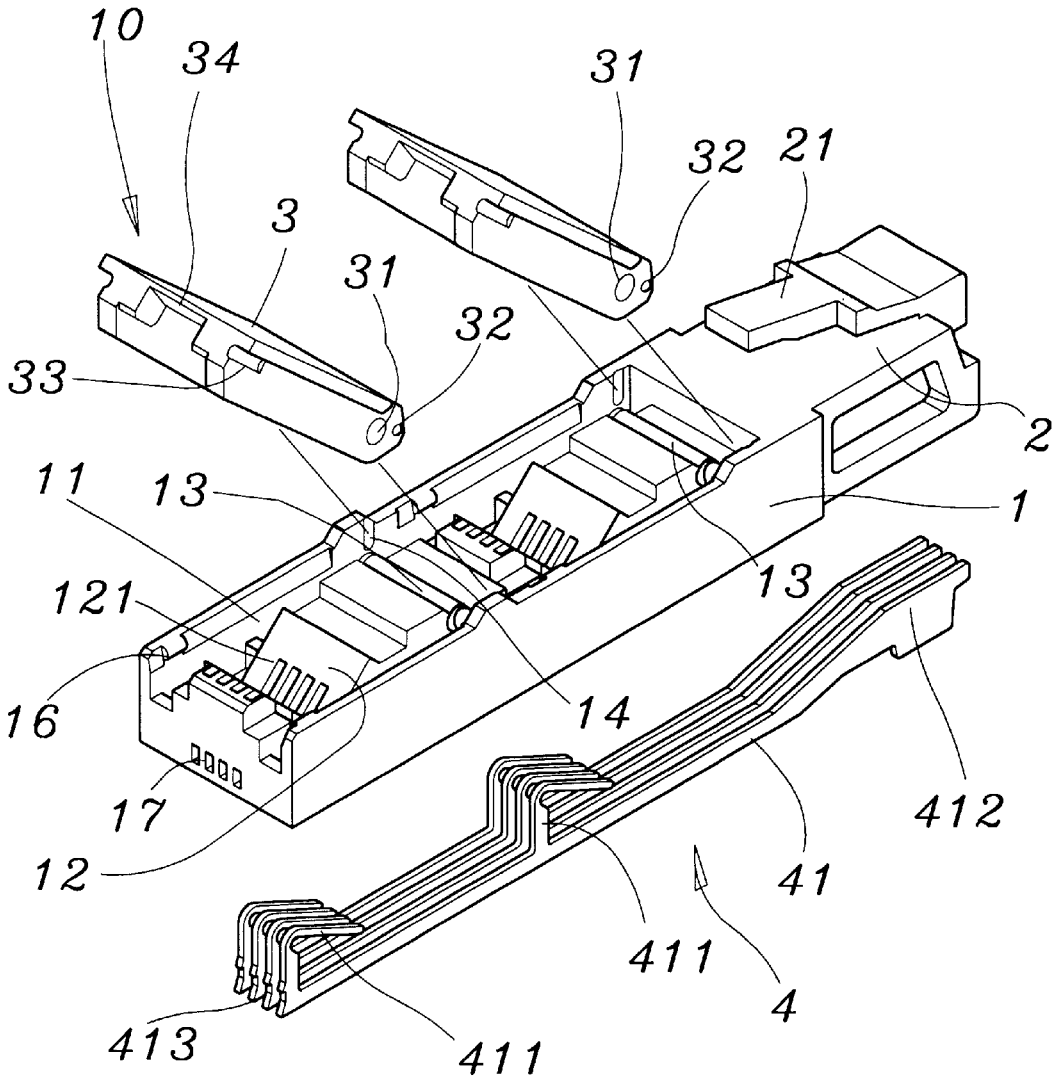
FIG. 1*a* is a perspective view of the signal adaptation plug of the American specification according to the present invention.
Figure 2:
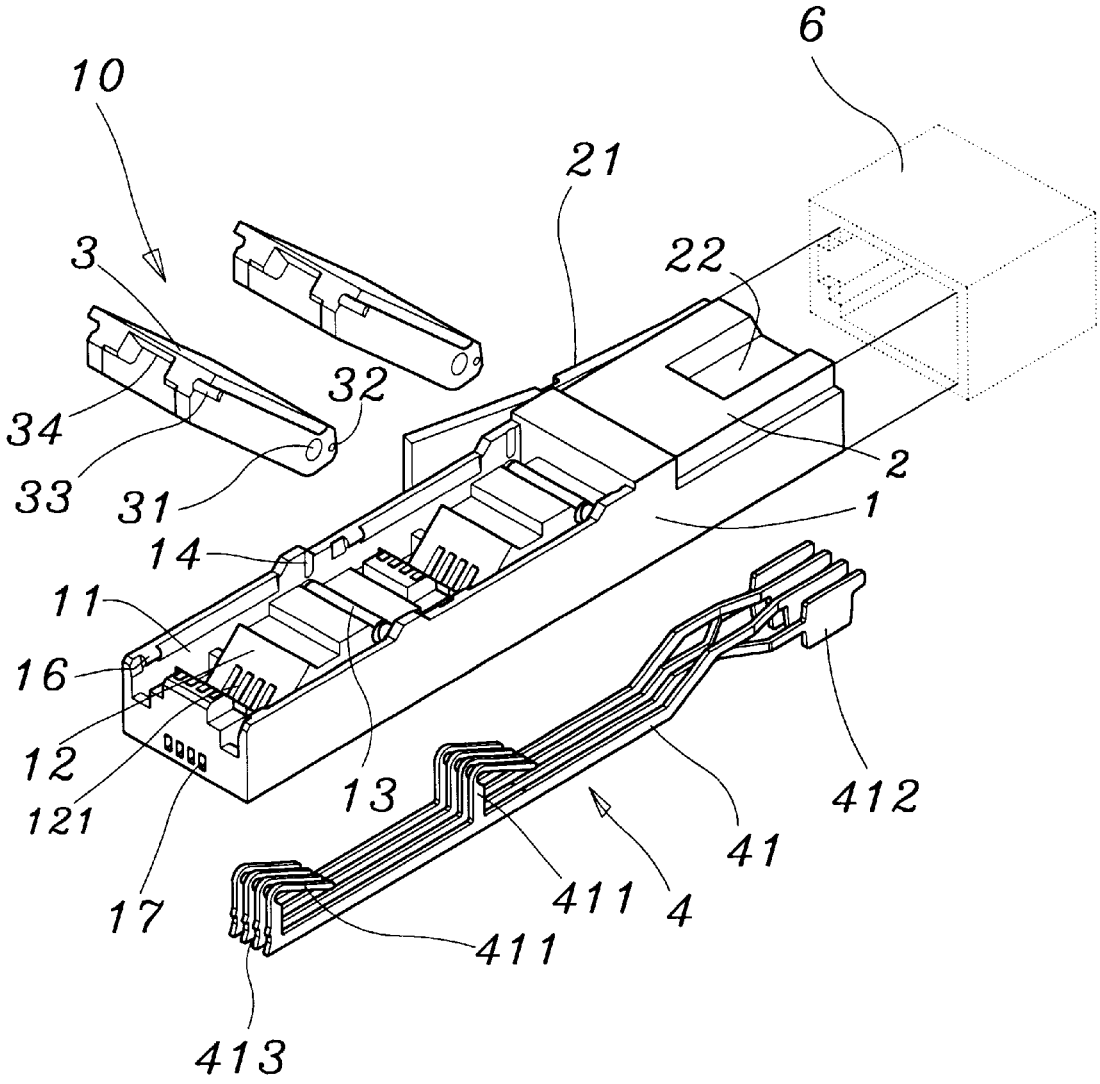
FIG. 2 is a perspective view of the signal adaptation plug of English specification according to the present invention.
Figure 5:
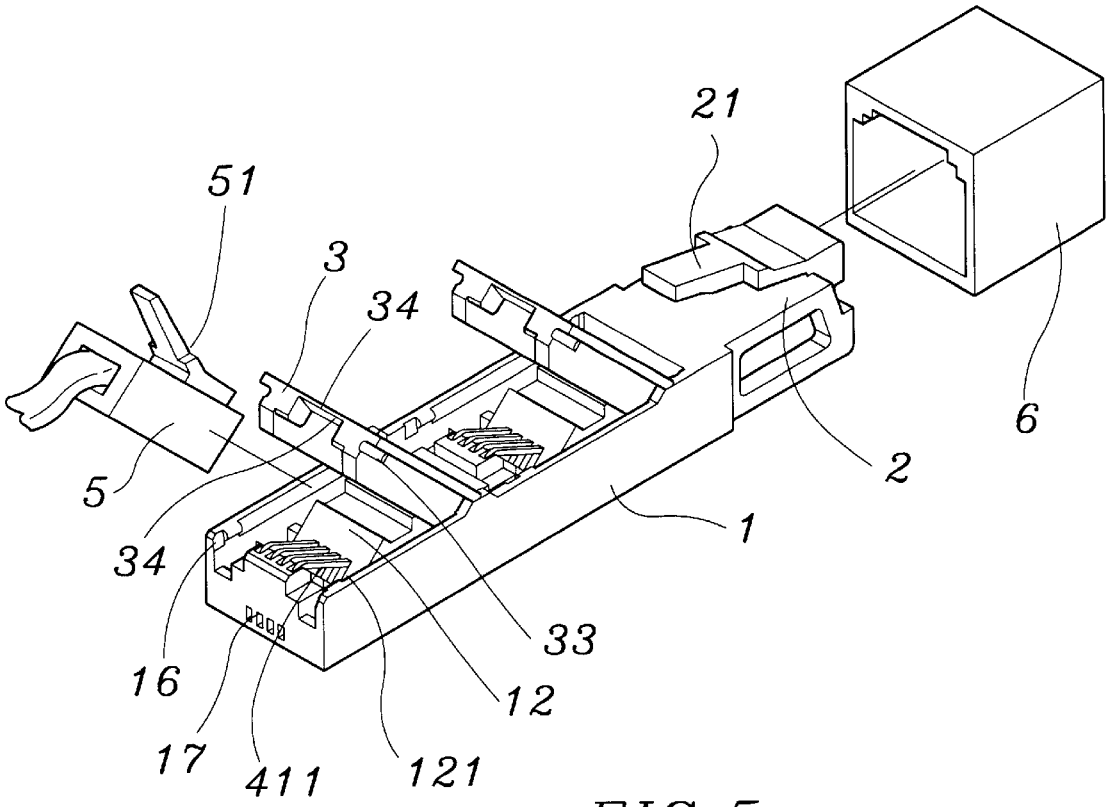
FIG. 5 is a perspective view of the cover plate installed erectly slantingly on the stage according to the present invention.

As shown in FIG. 1*a,* the signal adaptation plug 10 of the present invention has a stage 1 with a connector 2 formed on one side. The signal adaptation plug 10 is of American specification. The connector 2 has a lock part 21 on the top to lock inside the socket 6 (as shown in FIG. 5). As shown in FIG. 2, the signal adaptation plug 10 is of English specification. The connector 2 has a groove 22 formed on the top and has a lock part 21 on one side to lock inside the socket 6. The signal adaptation plug 10 of English specification can also be used as the communication plug such as the plug for high-speed transmission. The statements below all illustrate the signal adaptation plug of American specification.

Figure 1B:
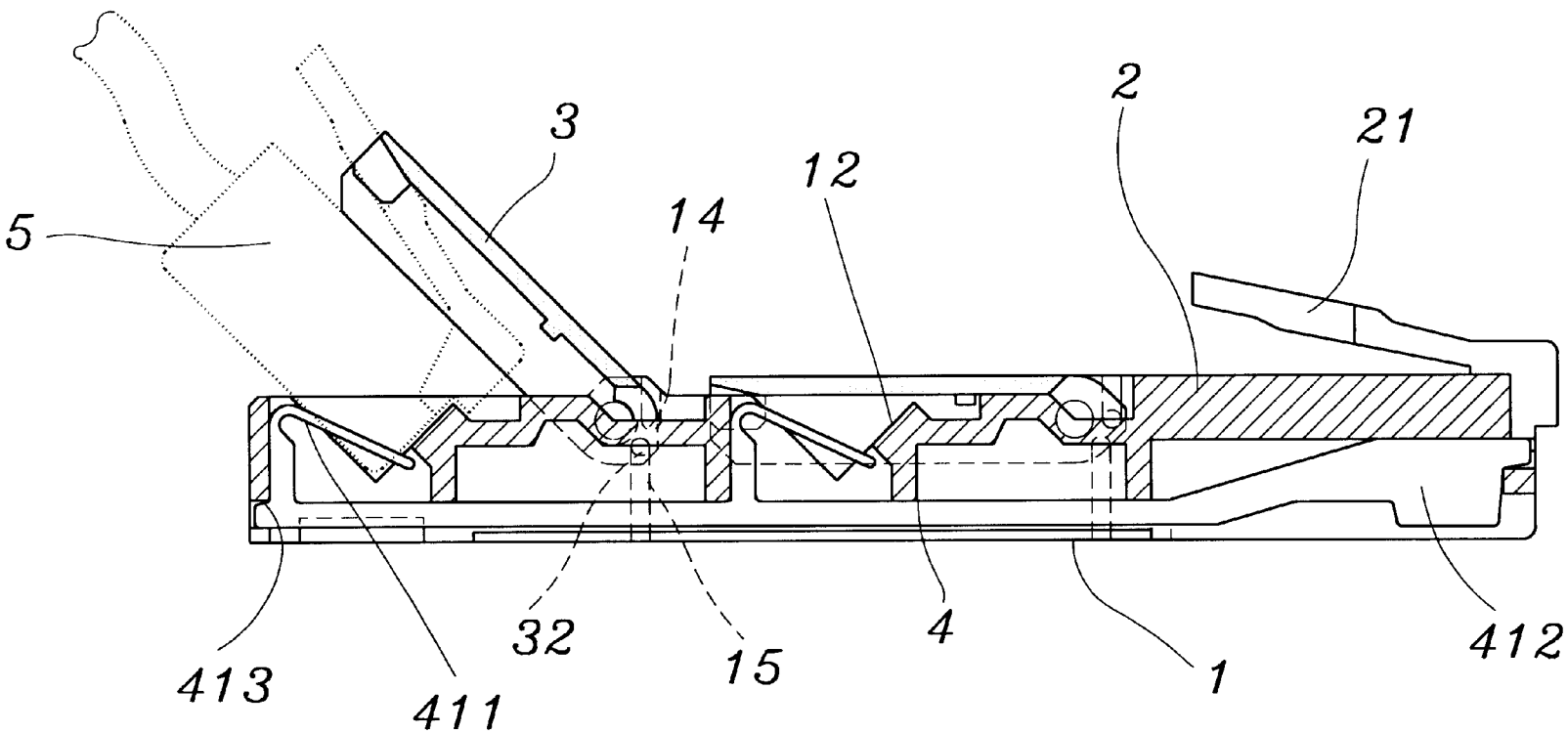
FIG. 1*b* is a cross section view of the stage according to the present invention.

As shown in FIG. 1*a,* the stage 1 has at least an accommodation groove 11, which has a slanting contact surface 12 with several gap grooves 121. One side of the accommodation groove 11 hinges a rotatable cover plate 3. The side of the cover plate 3 hinging the stage 1 has a hole 31 on each end. The vicinity of the hole 31 has a shaft 32. The place on the stage 1 corresponding to the hole 31 has a convex shaft 13. The two ends of the convex shaft 13 are locked in the holes 31 on the two ends of the cover plate 3. The two side walls of the stage 1 corresponding to the shaft 32 has a upper track 14 and a lower track 15. As shown in FIG. 1*b,* when the cover plate 3 is erected slantingly, the shaft 32 on the cover plate 3 is situated at the lower track 15. When the cover plate 3 covers levelly on the stage 1, the shaft 32 on the cover plate 3 is pushed to the upper track 14. The two ends of the side of the cover plate not hinging the stage 1 has a lock groove 33. The corresponding place inside the stage 1 has a convex pole 16. The side of the cover plate 3 not hinging the stage 1 forms a concave groove 34 to connect the lock part 51 of the plug 5.

Figure 4:
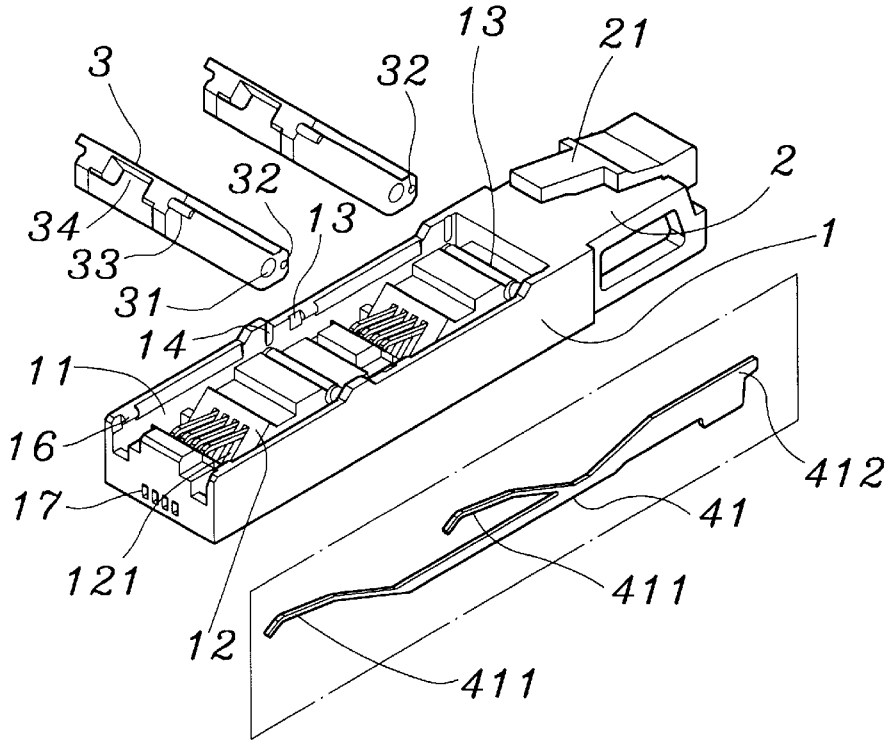
FIG. 4 is a perspective view of another pin terminal used in the signal adaptation plug according to the present invention.
Figure 3:
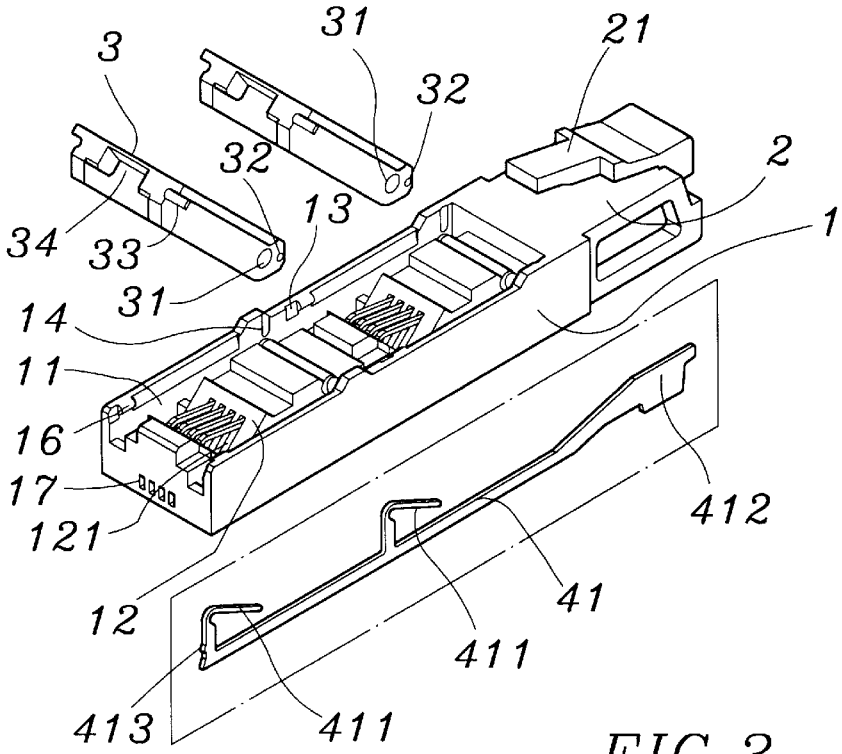
FIG. 3 is a perspective view of a pin terminal used in the signal adaptation plug according to the present invention.

As shown in FIGS. 1*a* and 3, the terminal assembly 4 is composed of several pin terminals 41 to be installed inside the stage 1. The pin terminal 41 forms a first contact part 411 and a second contact part 412 at the accommodation groove 11 and the connector 2 of the stage 1. The first contact part 411 of the pin terminal 41 emerges from the gap groove 121 of the contact surface 12 of the stage 1 and extends forward. The terminal assembly 4 has hooks 413 at the tail end. When the terminal assembly 4 is embedded inside the stage 1, the hook 413 is locked inside the lock groove 17 installed on the stage 1. As shown in FIG. 2, the signal adaptation plug 10 of English specification can be used as the communication plug such as the plug for high-speed transmission. The second contact part 412 of the terminal assembly 4 is alternately arranged. As shown in FIG. 4, the first contact part 411 of another form of the terminal assembly 4 extends backward.

As shown in FIGS. 1 and 5, when the user travels to the England, the plug 5 of American specification are not compatible with the local socket 6. The signal adaptation plug 10 of English specification shown on FIG. 2 can be used to connect the plug of American specification. When the cover plate 3 is switched upward, it rotates with the convex shaft 13 on the stage 1 as the axis. The shaft 32 on the cover plate 3 is pushed downward to the lower track 15 to let the cover plate 3 be erected slantingly on the stage 1. The plug 5 is then slantingly plugged between the accommodation groove 11 and the cover plate 3. The lock part 51 of the plug 5 is locked inside the concave groove 34 on the cover plate 3 to fix the plug 5 on the stage 1. The pin terminal of the plug 5 contacts with the first contact part 411 of the pin terminal 41 inside the stage 1. The connector 2 of the signal adaptation plug 10 is thus plugged on the socket 6.

Figure 6:
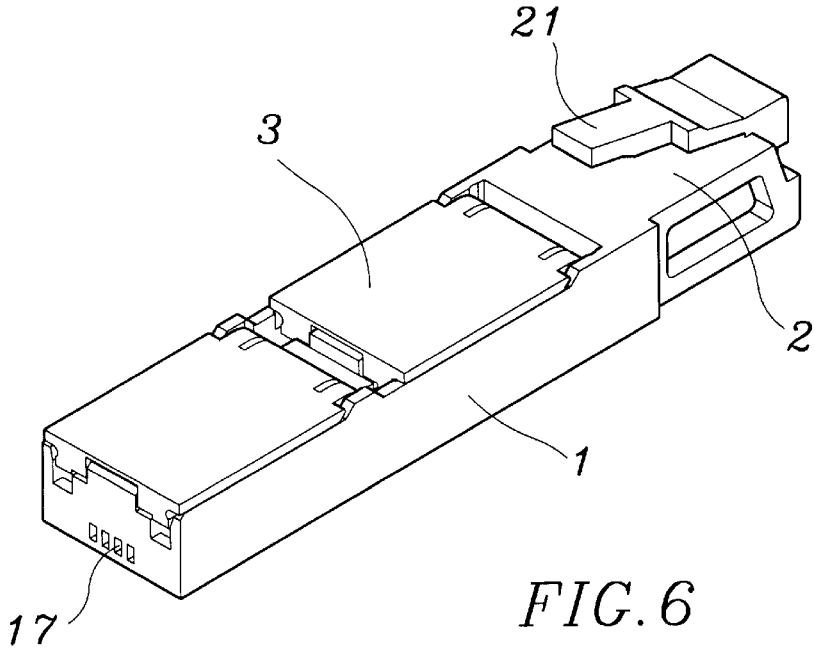
FIG. 6 is a perspective view of the cover plate covered levelly on the stage according to the present invention.

As shown in FIGS. 1*b* and 6, when the signal adaptation plug 10 is not used, the cover plate 3 is rotated with the convex shaft 13 on the stage 1 as the axis. The shaft 32 on the cover plate 3 is pushed upward to the upper track 14 to let the cover plate 3 cover on the stage 1. The convex pole 16 of the stage 1 will be embedded in the lock groove 33 on the other side of the cover plate 3. The cover plate 3 is thus fixed on the stage 1.

Figure 7:
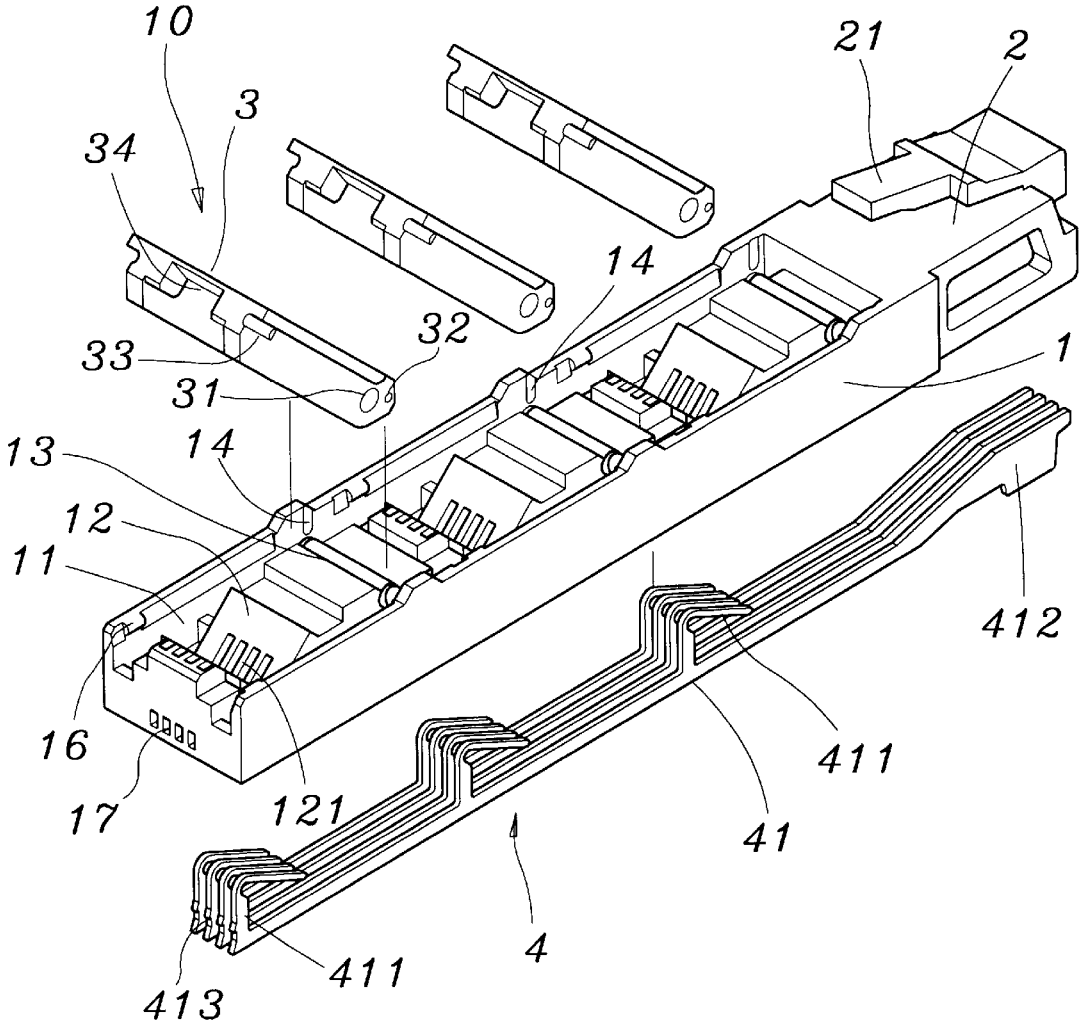
FIG. 7 is a perspective view showing endless extension of the signal adaptation plug according to an embodiment of the present invention.

As shown in FIG. 7, the stage 1 has multiple accommodation grooves 11 to increase the usage convenience. There are three accommodation grooves 3 in this embodiment to plug several plugs 5. This gives the signal adaptation plug 10 endless extension function.

Figure 8:
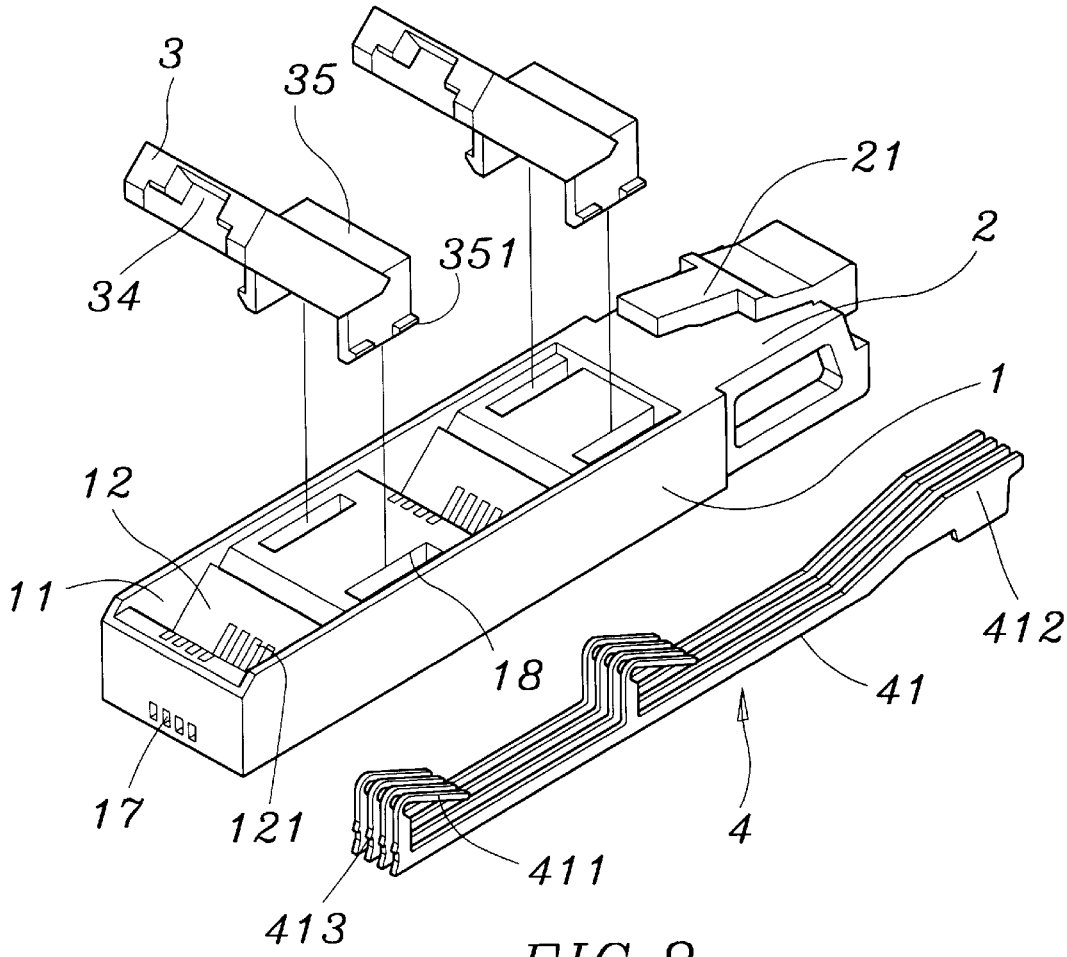
FIG. 8 is a perspective view of the fixed cover plate before installation according to another embodiment of the present invention.
Figure 9:
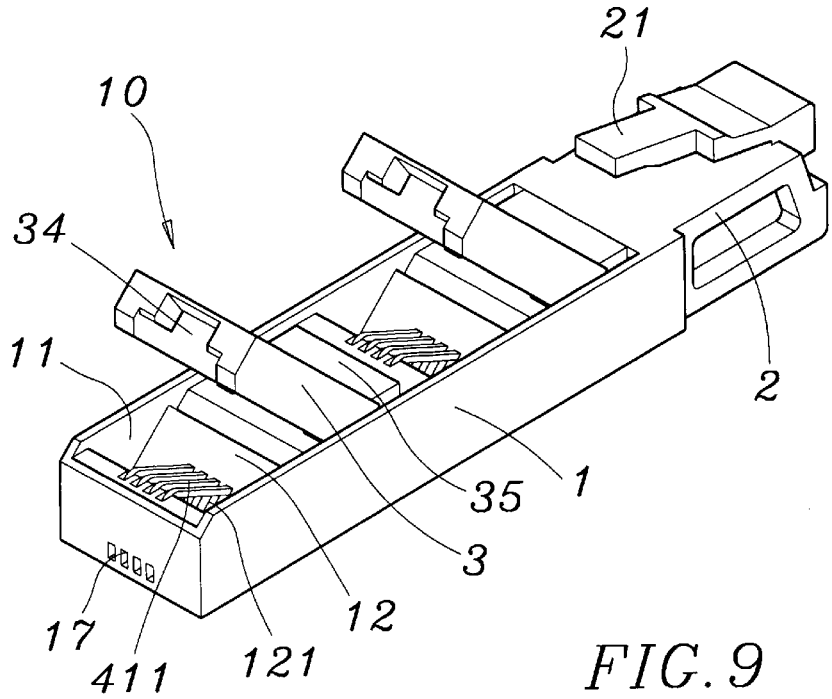
FIG. 9 is a perspective view of the fixed cover plate after installation according to another embodiment of the present invention.
Figure 10:
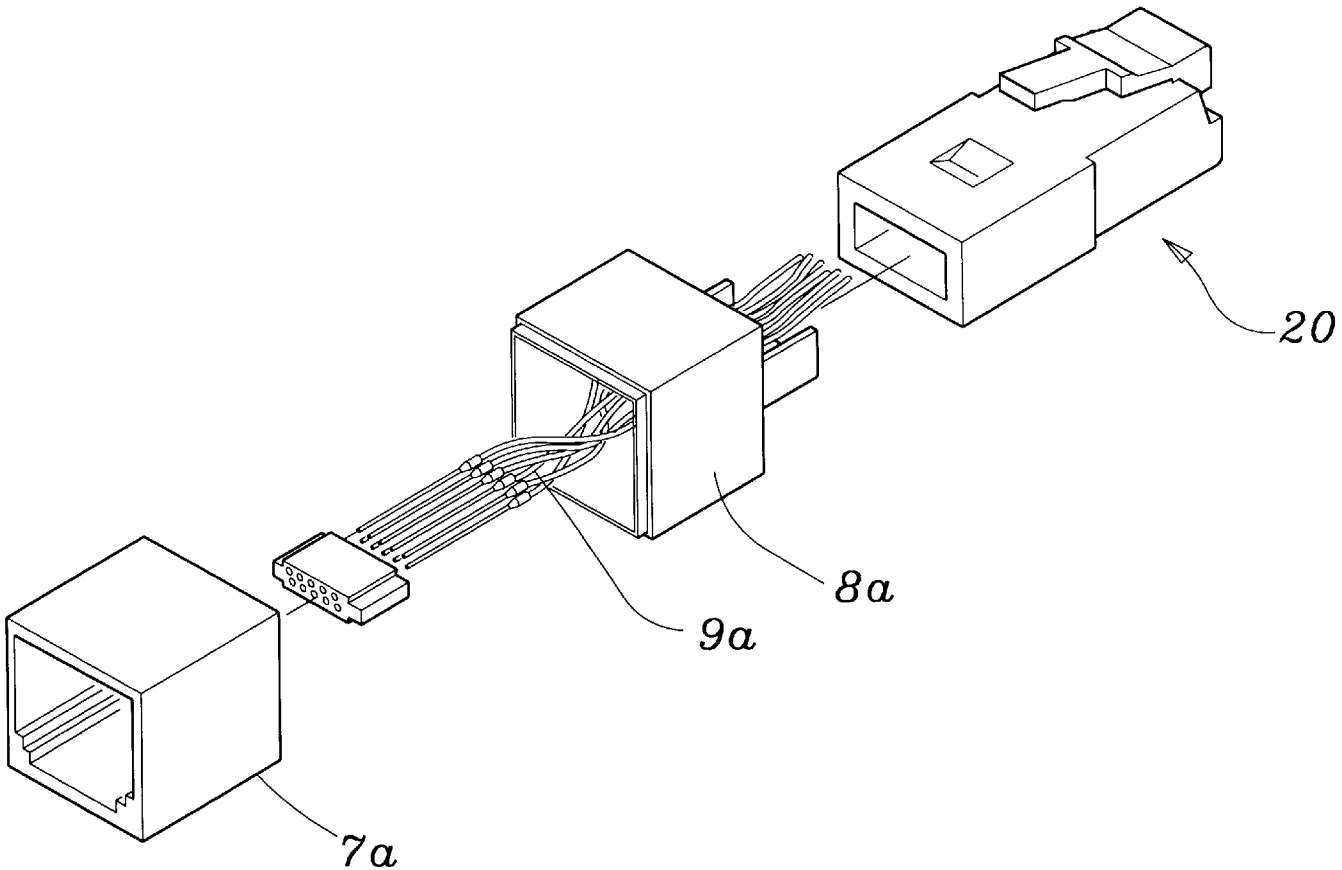
FIG. 10 PRIOR ART
FIG. 10 is a perspective view of the conventional signal adaptation plug.

As shown in FIG. 8, the cover plate 3 is fixed. The side of the cover plate 3 fixed on the stage 1 extends to form a retaining stage 35. The two sides of the retaining stage 35 has embedding hooks 351. The side adjoining the contact surface 12 on the stage 1 corresponding to the embedding hooks 351 has hook holes 18. The embedding hooks 351 are hooked at the hook holes 18 to let the cover plate 3 be fixed erectly slantingly on the stage 1. As shown in FIG. 9, the cover plate 3 can not cover on the stage 1.

To sum up, the signal adaptation plug 10 of the present invention is integrally formed and has a small volume, the manufacture and assembly is thus simple and convenient. The production cost is also reduced. Moreover, the signal adaptation plug of the present invention is dust-proof and can avoid bad contact.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A signal adaption plug, comprising:

a longitudinally extended stage having a connector formed on a first longitudinal end thereof adapted for releasable coupling with a socket and having at least one accommodation groove formed therein, said accommodation groove having a contact surface, said contact surface having a plurality of gap grooves formed therein, said stage having a pair of transversely directed lower tracks respectively formed in opposing side walls bordering said accommodation groove and a pair of transversely directed upper tracks respectively formed in opposing side walls bordering said accommodation groove and spaced from said lower tracks;

at least one cover plate having a first end hingedly coupled to said stage and being situated on one side of said accommodation groove, said cover plate being reversably positionable from a first position levelly covering said accommodation groove to an angularly directed second position for releasable engagement with a locking member of a plug received within said accommodation groove, said cover plate having a pair of shafts extending from opposing sides thereof, said pair of shafts being respectively disposed in said upper tracks when said cover plate is in said first position, said pair of shafts being respectively displaced to said lower tracks when said cover plate is displaced to said second position for holding said cover plate in said second position; and, a terminal assembly composed of a plurality of pin terminals and installed inside said stage, said pin terminals each having at least one first contact part in said accommodation groove and a second contact part disposed in said connector of said stage, said first contact part of said pin terminals passing through a respective gap groove of the contact surface of said stage.

2. The signal adaption plug as in claim 1, wherein said connector includes a lock part formed on a top portion for releasable engagement with a groove of the socket.

3. The signal adaption plug as in claim 1, wherein said connector includes a lock part formed on one of said side walls of said stage for releasable engagement with a groove of the socket.

4. The signal adaption plug as in claim 1, wherein said cover plate has a pair of lock grooves formed on opposing sides thereof adjacent a second end of said cover plate, said stage having a pair of convex poles respectively formed on an inside surface of said side walls in correspondence with said pair of lock grooves for latching said cover plate in said first position.

5. The signal adaption plug as in claim 3, wherein said second contact part of each said pin terminals is disposed in longitudinal alignment with said first contact part of an adjacent one of said pin terminals.

6. The signal adaption plug as in claim 1, wherein said stage has a plurality of lock grooves formed on a second end thereof and each said pin terminal has a hook formed on a tail end thereof lockingly engaged with a corresponding one of said lock grooves.

7. The signal adaption plug as in claim 1, wherein said stage has a plurality of accommodation grooves to receive a corresponding number of plugs therein, each said accommodation groove having a respective cover plate associated therewith and each said pin terminal having a plurality of first contact parts disposed in respective correspondence with said plurality of accommodation grooves.

8. A signal adaption plug, comprising:

a longitudinally extended stage having a connector formed on a longitudinal end thereof adapted for releasable coupling with a socket and having at least one accommodation groove formed therein, said accommodation groove having a contact surface, said contact surface having a plurality of gap grooves formed therein, said stage having a plurality of hook holes formed adjacent said contact surface;

at least one cover plate coupled to said stage and being situated on one side of said accommodation groove, said cover plate being fixed on said stage by a retaining stage, said cover plate being affixed to said retaining stage and extends angularly therefrom for releasable engagement with a locking member of a plug received within said accommodation groove, said retaining stage having a plurality of embedding hooks extending from opposing sides thereof for respective engagement with said hook holes; and, a terminal assembly composed of a plurality of pin terminals and installed inside said stage, said pin terminals each having at least one first contact part in said accommodation groove and a second contact part disposed in said connector of said stage, said first contact part of said pin terminals passing through a respective gap groove of the contact surface of said stage.

9. A signal adaption plug, comprising:

a longitudinally extended stage having a connector formed on a longitudinal end thereof adapted for releasable coupling with a socket and having a plurality of longitudinally spaced accommodation grooves formed therein, each of said accommodation grooves having a contact surface, said contact surface having a plurality of gap grooves formed therein, said stage having a pairs of transversely directed lower tracks respectively formed in opposing side walls bordering each said accommodation groove and a pair of transversely directed upper tracks respectively formed in opposing side walls bordering each said accommodation groove and spaced from said corresponding lower tracks;

a plurality of cover plates, each said cover plate having a first end hingedly coupled to said stage on one side of a respective one of said plurality of accommodation grooves, said cover plate being reversably positionable from a first position levelly covering a respective accommodation groove to an angularly directed second position for releasable engagement with a locking member of a plug received within said respective accommodation groove, each said cover plate having a pair of shafts extending from opposing sides thereof, said pair of shafts being respectively disposed in a corresponding pair of said upper tracks when said cover plate is in said first position, said pair of shafts being respectively displaced to a corresponding pair of said lower tracks when said cover plate is displaced to said second position for holding said cover plate in said second position; and, a terminal assembly composed of a plurality of pin terminals and installed inside said stage, said pin terminals each having a plurality of first contact parts respectively positioned in said plurality of accommodation grooves and a second contact part disposed in said connector of said stage, each said first contact part of said pin terminals passing through a respective gap groove of a corresponding contact surface of said stage.

* * * * *